US011259613B2

(12) United States Patent
Debauge et al.

(10) Patent No.: US 11,259,613 B2
(45) Date of Patent: Mar. 1, 2022

(54) COSMETIC PRODUCT REFILL FOR A DEVICE FOR TREATING THE HAIR HAVING A HEATING ELEMENT, AND DEVICE FOR TREATING THE HAIR INCLUDING SUCH A REFILL

(71) Applicant: SEB S.A., Ecully (FR)

(72) Inventors: Anne Debauge, Saint-Ouen (FR); Regis Fereyre, Lyons (FR); Baptiste Bonnemaire, Lyons (FR); Martial Maisonneuve, Villefontaine (FR); Vacheron Xavier, Genas (FR)

(73) Assignee: SEB S.A.

( * ) Notice: Subject to any disclaimer, the term of this patent is extended or adjusted under 35 U.S.C. 154(b) by 638 days.

(21) Appl. No.: 16/063,091

(22) PCT Filed: Dec. 16, 2016

(86) PCT No.: PCT/EP2016/081606

§ 371 (c)(1),
(2) Date: Jun. 15, 2018

(87) PCT Pub. No.: WO2017/103228

PCT Pub. Date: Jun. 22, 2017

(65) Prior Publication Data

US 2020/0275753 A1 Sep. 3, 2020

(30) Foreign Application Priority Data

Dec. 18, 2015 (FR) ..... 1562754

(51) Int. Cl.
*A45D 1/06* (2006.01)
*A45D 1/04* (2006.01)
(Continued)

(52) U.S. Cl.
CPC ..... *A45D 1/06* (2013.01); *A45D 1/04* (2013.01); *A45D 2/001* (2013.01);
(Continued)

(58) Field of Classification Search
CPC . A45D 1/06; A45D 1/04; A45D 2/001; A45D 2001/002; A45D 2001/008;
(Continued)

(56) References Cited

U.S. PATENT DOCUMENTS 10,485,319 B2 * 11/2019 Fereyre ..... A45D 2/001
2009/0025247 A1 1/2009 Yde et al.
(Continued)

FOREIGN PATENT DOCUMENTS

GB 243634 A 12/1925
JP 2014-97214 A 5/2014
(Continued)

OTHER PUBLICATIONS

International Search Report dated Feb. 24, 2017 in PCT/EP2016/081606 filed Dec. 16, 2016.
(Continued)

*Primary Examiner* — Nicholas D Lucchesi
(74) *Attorney, Agent, or Firm* — Lerner, David, Littenberg, Krumholz & Mentlik, LLP

(57) ABSTRACT

The invention relates to a cosmetic product refill for a device for treating hair, which includes at least one heating element, the cosmetic product refill including a rib or groove for fastening the refill to the device and a cosmetic product applicator element in the form of a sheet, such that the rib or groove is designed to fasten the cosmetic product refill to the device for treating the hair in such a way that a part of the cosmetic product refill is offset laterally with respect to the heating element(s), and such that at least one portion of the applicator element is designed to extend next to the heating element(s). The invention also relates to a device for treating the hair including such a refill.

20 Claims, 3 Drawing Sheets

(51) Int. Cl.
*A45D 2/00* (2006.01)
*A45D 1/00* (2006.01)
*A45D 34/00* (2006.01)

(52) U.S. Cl.
CPC .. *A45D 2001/002* (2013.01); *A45D 2001/008* (2013.01); *A45D 2034/005* (2013.01)

(58) Field of Classification Search
CPC ..... A45D 2034/005; A45D 2007/001; A45D 2007/002; A46B 9/023; A46B 2200/104; A46B 15/003
See application file for complete search history.

(56) References Cited

U.S. PATENT DOCUMENTS

| | | | | |
|---|---|---|---|---|
| 2002/0289622 | | 10/2015 | Fereyre et al. | |
| 2015/0289622 | A1* | 10/2015 | Fereyre | A45D 1/06 132/211 |

FOREIGN PATENT DOCUMENTS

| | | | |
|---|---|---|---|
| KR | 10-2015-0079776 | A | 7/2015 |
| WO | WO 2004/041021 | A2 | 5/2004 |
| WO | WO 2009/015027 | A2 | 1/2009 |
| WO | WO 2009/078046 | A1 | 6/2009 |
| WO | WO 2013/045331 | A1 | 4/2013 |
| WO | WO 2013/090896 | A1 | 6/2013 |

OTHER PUBLICATIONS

French Preliminary Search Report dated Aug. 17, 2016 in Patent Application No. 1562754 filed Dec. 18, 2015.

Office Action dated Jun. 24, 2019 in Korean Patent Application No. 10-2018-7017046, 9 pages (with unedited computer generated English translation).

* cited by examiner

COSMETIC PRODUCT REFILL FOR A DEVICE FOR TREATING THE HAIR HAVING A HEATING ELEMENT, AND DEVICE FOR TREATING THE HAIR INCLUDING SUCH A REFILL

The present invention relates to a device for treating the hair, and more particularly, but not exclusively, to a device intended for shaping the hair, notably intended for straightening, curling or crimping the hair, comprising a cosmetic product applicator.

The invention relates more particularly to a device comprising two jaws that are able to move with respect to one another and are able to take up a spaced-apart configuration for introducing a lock of hair between said jaws and a moved-together configuration for treating the lock, the jaws being movable along the lock in this moved-together configuration. In such a device, each jaw frequently carries a heating element such that the hairs of the lock pass between the two heating elements during the use of the device.

BACKGROUND

Numerous devices of this type, sometimes also known as hair straighteners or straightening irons, have already been proposed.

Usually, hair straighteners consist of two arms that are connected together with the aid of a hinge which makes it possible to open and close the arms, and of at least one heating element disposed on the arms. During operations of styling a lock of hair, said lock is introduced between the two arms in the open position and then the two arms are closed manually over the lock of hair. The lock of hair is then subjected to the heat output by the heating element(s), until the two arms are opened and the lock of hair is removed.

The application WO-A-2009/078046 describes a hairstyling appliance comprising two arms that are connected together so as to allow the appliance to be opened and closed, at least one heating member and at least one seat for accommodating a hair treatment device, the latter allowing a haircare product to be dispensed during operation. The hair treatment device is composed of a support material impregnated with a haircare product. The hair treatment device is suitable for a single use.

WO-A-2009/015027 and US-A-2009/0025247 disclose a hair straightening device that makes it possible to apply a haircare product by contact with the hair. The haircare product to be applied is contained in a removable refill for the application thereof. Said removable refill comprises a reservoir containing the haircare product in a gelled form, and orifices for dispensing and applying the product, said orifices being made directly through a wall of the reservoir. The refill is introduced into a housing disposed on one of the two arms of the hair straightener, by sliding.

The application WO-A-2013/045331 likewise discloses an applicator for applying a care substance to the hair, comprising a cartridge of care substance held in a housing of the applicator. The cartridge comprises a porous support saturated with the care substance.

The application WO-A-2013/090896 relates to a hair treatment appliance, notably a hairstyling appliance, provided with a cartridge of treatment agent that can be removed. The cartridge of treatment agent substantially comprises a treatment agent holder, notably made of saturated porous material, to be applied to the hair or the skin, said holder being fastened to an accessory that forms a mechanical holder and a grip tab. The cartridge is mounted in a housing of the hair treatment appliance, said housing having a section complementary to the section of the cartridge of treatment agent.

These devices are relatively bulky. They have, notably, a large width compared with the effective width over which a lock of hair is effectively heated by the heating elements.

Furthermore, WO-A-2004/041021 discloses a device for treating the hair, comprising two arms that pivot with respect to one another between a spaced-apart position and a moved-together position for treating the hair. Each arm is provided with a heated element that is designed to be in contact with the hair to be treated. According to that document, the device for treating the hair also comprises a fabric gripped between two frames of a fastening jaw, each jaw in turn being fastened to one of the arms or to one of the heated elements. When the jaw is fastened to a heated element, it is necessary to wait for this element to cool in order to replace the fabric. When the jaw is fastened to an arm, it is not possible to apply the heated elements and the fabric along the entire length of the hair to be treated in a single movement. In this last case, the device for treating the hair can also be particularly voluminous. WO-A-2004/041021 indicates that, according to one variant, the fabric can take the form of a sock having an opening in order to be slid around the device for treating the hair. However, in that case, it is particularly tricky to handle the fabric. Moreover, a large quantity of product with which the fabric is impregnated is not applied to the hair treated.

Therefore, there is a need for an improved device for treating the hair which does not have the abovementioned drawbacks. Notably, there is a need for a device for treating the hair which is less bulky. There is also a need for a cosmetic product refill that is designed to be installed in such a device for treating the hair.

SUMMARY

Therefore, the subject of the invention is a cosmetic product refill for a device for treating the hair that comprises at least one heating element, the cosmetic product refill comprising a means for fastening the refill to the device and a cosmetic product applicator element in the form of a sheet, such that:

- the means for fastening the refill is designed to fasten the cosmetic product refill to the device for treating the hair in such a way that a part of the cosmetic product refill is offset laterally with respect to the heating element(s), and such that
- at least one portion of the applicator element is designed to extend next to the heating element(s).

Advantageously, it is no longer necessary to provide a pressing element next to the applicator element of the cosmetic product refill, the heating element fulfilling the function of the pressing element. It is thus possible to limit the bulk of the device for treating the hair, notably the width thereof.

Moreover, a part of the cosmetic product refill is not disposed next to the heating element(s). This can notably make it possible to handle the cosmetic product refill, optionally even when the device for treating the hair is in operation and the heating element(s) is/are hot. In a variant, this can make it possible to provide a cosmetic product reservoir in the refill while limiting the risk of evaporation of the cosmetic product contained in this reservoir.

Preferably, the cosmetic product refill according to the invention has one or more of the following features, on their own or in combination:

- the means for fastening to the device for treating the hair comprises a fastening relief;
- the relief comprises a rib, preferably with a T-shaped cross section;
- the fastening means is fastened to the applicator element, notably adhesively bonded to or overmoulded on the applicator element;
- the applicator element is curved or able to be curved so as to extend partially next to the heating element(s) of the device for treating the hair;
- the applicator element comprises a sheet of porous material, notably porous PTFE;
- the applicator element comprises a sheet of silicone;
- the applicator element is fibrous, notably made of cotton, the applicator element comprising encapsulated cosmetic product fixed to the fibres of the applicator element;
- the cosmetic product refill comprises a cosmetic product reservoir formed by a portion of the applicator element that is not intended to be in contact with the hair to be treated and that preferably has greater porosity than the portion of the applicator element that is intended to be in contact with the hair to be treated; and
- the applicator element has a thickness of between 0.1 mm and 3 mm.

According to another aspect, the invention relates to a device for treating the hair, comprising:

- at least one arm, preferably two arms that are able to move with respect to one another between a moved-together position for treating the hair to be treated and a spaced-apart position for inserting hair to be treated between said arms, at least one arm being provided with a heating element for the hair to be treated, preferably each arm being provided with a heating element for the hair to be treated such that the two heating elements face one another in the moved-together position of the arms; and
- a cosmetic product refill as described above in all its combinations, which is fastened to one of the movable arms.

Preferably, the device for treating the hair according to the invention has one or more of the following features, on their own or in combination:

- the arm to which the cosmetic product refill is fastened forms a housing for receiving the cosmetic product refill, said receiving housing preferably opening onto one side of the arm;
- the cosmetic product refill comprises a relief for fastening to an arm, said arm comprising a complementary fastening relief;
- said arm comprises one of a longitudinal groove and a longitudinal rib, the cosmetic product refill comprising the other of a longitudinal groove and a longitudinal rib, such that the cosmetic product refill is fastened to the arm by sliding; and
- the device for treating the hair comprises, on one of the arms, a steam outlet, the steam outlet preferably being disposed facing a portion of the applicator element of the cosmetic product refill.

DESCRIPTION OF THE FIGURES

The invention may be better understood from reading the following detailed description of non-limiting exemplary embodiments thereof and from examining the appended drawing, in which.

DETAILED DESCRIPTION

Figure 1:
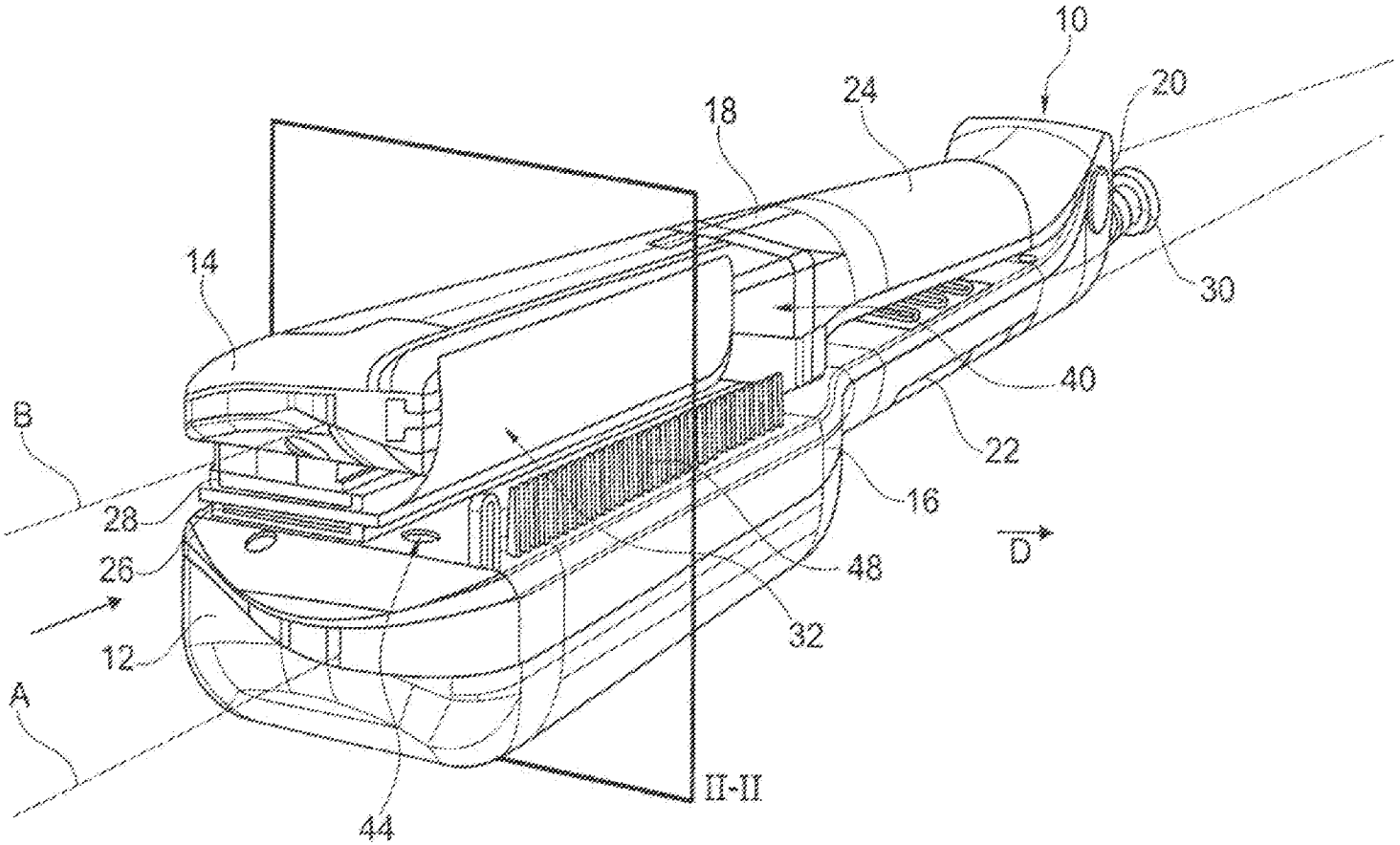
FIG. 1 is a schematic perspective view of an example of a device for treating the hair.
Figure 2:
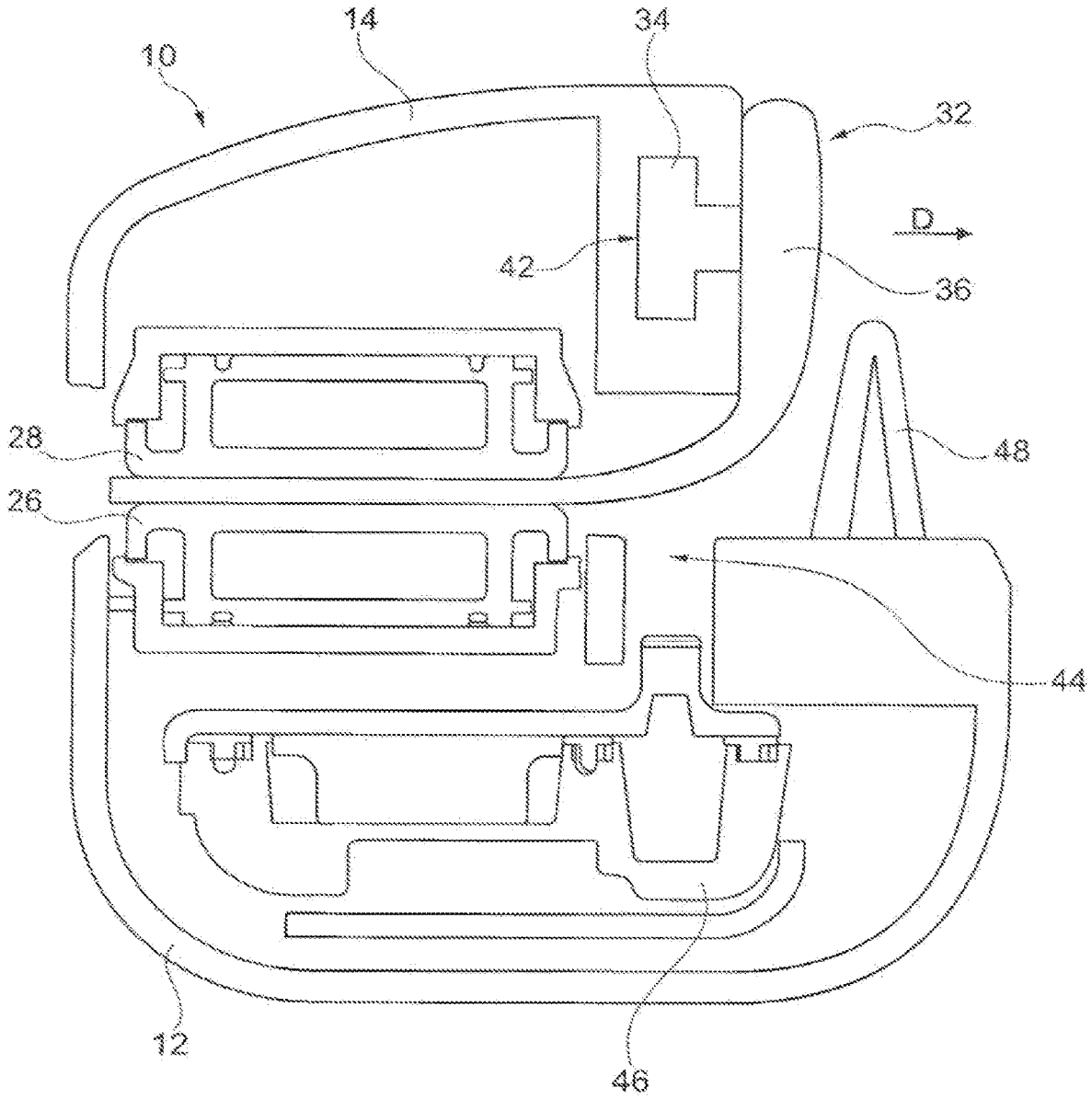
FIG. 2 is a cross section through the device from FIG. 1.

A handpiece 10 of an example of a device for treating the hair is shown in FIGS. 1 and 2. The illustrated device for treating the hair is for example a straightener having flat heating elements, which notably come into contact in the closed position.

The handpiece 10 has two jaws 12, 14 that are able to move with respect to one another between a spaced-apart configuration (not shown) for the introduction between said jaws of a lock of hair, and a moved-together configuration for treating the lock of hair.

The jaws 12, 14 are carried by a lower arm 16 and an upper arm 18, respectively. The lower arm 16 and upper arm 18 are, in the example in question, hinged with respect to one another by means of a hinge pin 20, the handpiece 10 thus forming tongs.

The lower arm 16 and upper arm 18 in this case each have a total length of between 22 cm and 37 cm. The lower arm 16 and upper arm 18 define, between the hinge pin 20 and the jaws 12, 14, respective half-handles 22, 24 on which the user can press in order to move the jaws 12, 14 together.

An elastic return member (not visible) can be provided to return the jaws 12, 14 into the spaced-apart configuration. This elastic return member can be in the form of a spring disposed around the hinge pin 20 of the lower arm 16 and upper arm 18.

Of course, the jaws 12, 14 can be rendered movable with respect to one another in some other way. They can notably be movable with respect to one another not by rotation, as is the case with a hinge, but by movement in translation. However, preference is given to the ergonomics provided by a hinge.

The jaws 12, 14 define between one another a region for treating the hair, said region being intended to receive a lock of hair to be treated, the handpiece 10 being moved along said lock during the treatment. The handpiece 10 is moved for example in the direction from the root to the tip of the hair of the lock, in the direction D shown in the figures.

The direction D of movement of the handpiece 10 over the hair, illustrated in FIGS. 1 and 2, is preferably substantially perpendicular to the median axis A, B of the lower arm 16 and upper arm 18, that is to say substantially parallel to the hinge pin 20.

In the example illustrated, the handpiece 10 is connected by a line 30 to a base station (not shown) that is fixed during the treatment and is itself connected to the mains. This base station provides the electric power supply to the handpiece 10 and also its supply with water in order to generate steam. The base station can also carry out additional functions of processing electrical signals received from the handpiece 10. The line 30 which connects the handpiece 10 to the base station can thus comprise various electrical conductors and a water supply pipe.

A user interface (not shown in the figures) can also be present on the handpiece 10, for example so as to allow the user to start up certain components thereof, or not.

As illustrated, each jaw 12, 14 comprises a heating element 26, 28 for the hair. In this case, each heating element 26, 28 is in the form of a plate made of a material that is a good conductor of heat, defining a hot surface for bringing into contact with the hair, the temperature of said surface being for example greater than or equal to 95° C., better still between 90 and 230° C.

Also provided here is the application of a cosmetic product. This application of a cosmetic product is ensured by means of a refill 32 (or cartridge) carried by one of the two arms, 16, 18, in this case the upper arm 18. The refill 32 is preferably for single use.

The refill 32 substantially comprises a means 34 for fastening to the handpiece and an element 36 for applying a cosmetic product to the hair to be treated, the refill 32 being designed such that, once fastened to the arm 18, the applicator member is able to come into contact with the hair extending between the heating elements 26, 28.

The fastening means 34 makes it possible to fasten the cosmetic product refill 32 to the device for treating the hair in such a way that a part of the cosmetic product refill is offset laterally with respect to the heating element(s) 26, 28. This can make it possible to handle the cosmetic product refill 32, optionally even when the device for treating the hair is in operation and the heating element(s) 26, 28 is/are at a high temperature. This can also make it possible to keep a part of the cosmetic product refill at a distance from these heating elements, said part then being able to function as a cosmetic product reservoir. This is because, this part of the refill 32 that is at a distance from the heating elements 26, 28 is subjected to a lower temperature.

The applicator element 36 itself is produced in the form of a sheet. This makes it possible to fasten the applicator element 36 to the arm in the vicinity of a first end of the sheet, while keeping a part of the sheet, disposed in the vicinity of the opposite end, at the heating elements 26, 28. Thus, only one portion of the applicator element 36 is in this case designed to extend next to the heating elements 26, 28.

Figure 2A:
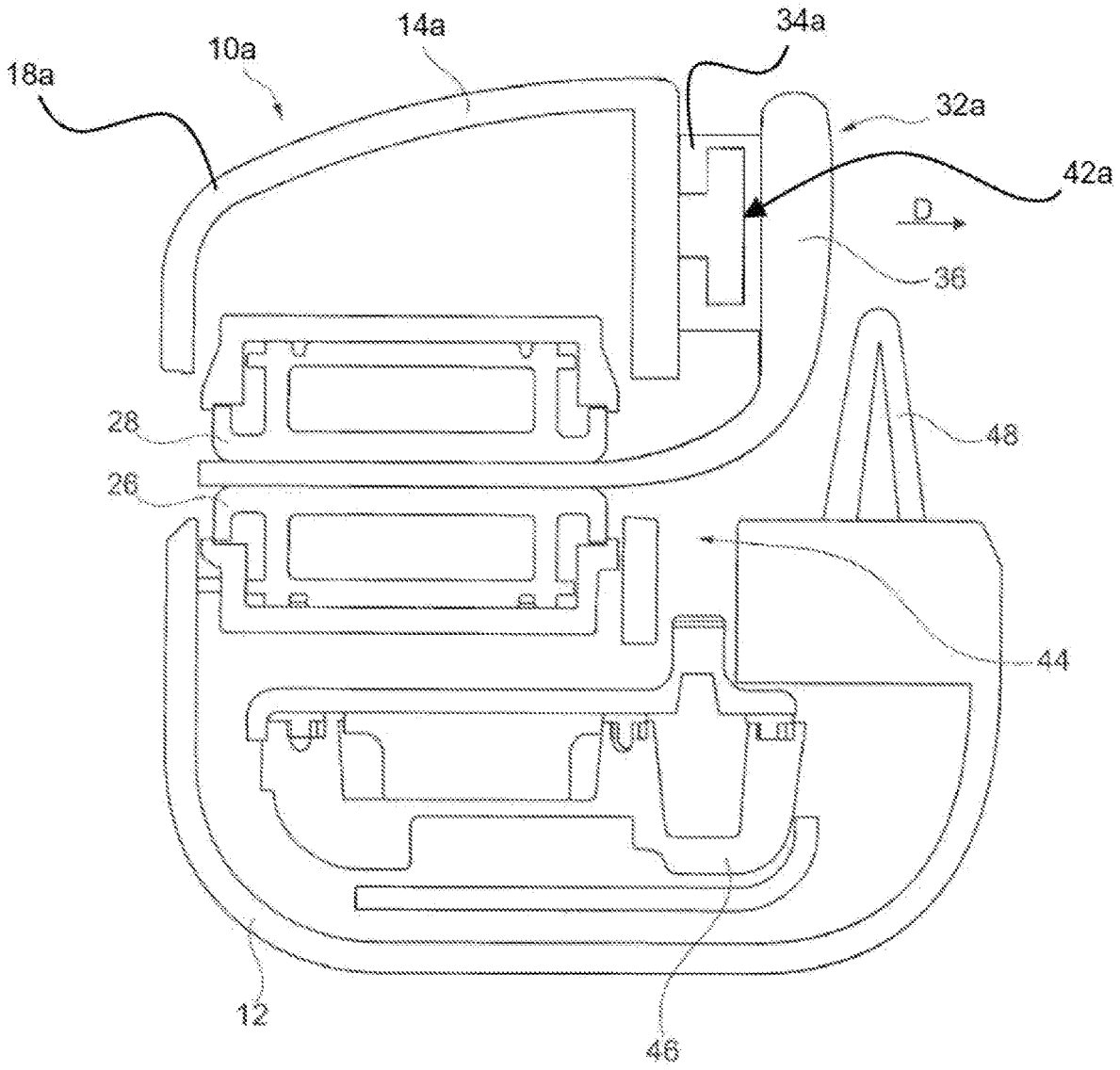
FIG. 2A is a cross section of another embodiment of the device from FIG. 1.

The means 34 for fastening the refill 32 is in this case in the form of a rib with a T-shaped cross section that is designed to be received, by sliding substantially parallel to the axis B of the upper arm 18, in a complementary relief 42, in this case a groove with a T-shaped cross section. Thus, the refill 32 is inserted into a receiving housing 40, provided for this purpose in the upper arm 18, by sliding in a direction substantially parallel to the longitudinal axis B of the upper arm. The receiving housing 40 thus opens onto the front of the arm 18 so as to allow the insertion of the cartridge by sliding. However, the housing 40 can also open onto the side of the arm 18, in order in this way to further limit the lateral bulk of the device for treating the hair. As indicated above, in an alternate embodiment of a handpiece 10*a* as shown in FIG. 2A, the means 34*a* for fastening the refill 32*a* can be in the form of a relief 42*a*, which is a groove with a T-shaped cross section. The jaw 14*a* of the upper arm 18*a* includes a rib with a T-shaped cross section that is designed to be received in the complementary relief 42*a*.

The fastening means 34 is in this case fastened directly to the applicator element 36. The refill 32 thus has a particularly simple design. For example, the fastening means 34, notably the fastening relief, is adhesively bonded to or overmoulded on the applicator element 36. In a variant, the fastening means 34 is produced in one piece with the applicator element. According to yet another variant, the fastening means is fastened to, secured to or produced in one piece with a framework forming a housing for receiving the applicator element 36. In this case, the applicator element can be gripped in the receiving housing of the framework in order to hold it in place. Lugs projecting into the receiving housing can be provided in order to make it easier to insert the applicator element 36 into the receiving housing while ensuring satisfactory fastening of said applicator element 36.

As mentioned above, the applicator element 36 is produced in the form of a sheet. A sheet is understood here to mean essentially a structure having two dimensions—length and width—greater than the third dimension, corresponding to the thickness. Notably, the ratio between the length and the thickness of the sheet may be greater than 5, preferably greater than 10. The sheet is for example substantially rectangular with a width of between 25 and 70 mm, preferably equal to 50 mm, and a length of between 60 and 120 mm, preferably equal to 90 mm. Preferably, the sheet does not have superposed portions so as to optimize the useful surface thereof that is intended to come into contact with the hair to be treated.

The sheet is curved or has flexibility allowing it to be curved, such that at least a part of the applicator element 36 extends next to the heating elements 26, 28, notably between the heating elements 26, 28.

The applicator element 36 may notably comprise a porous sheet that is impregnated with cosmetic product to be applied to the hair. The applicator element 36 thus dispenses the cosmetic product onto the hair, in contact therewith. In this case, the sheet is made for example of PTFE. The sheet can then have a thickness of between 0.1 and 3 mm. When the applicator element is porous, it can comprise a portion which is not intended to come into contact with the hair to be treated which has greater porosity than a portion intended to come into contact with the hair to be treated. The portion with greater porosity can in this case function as a cosmetic product reservoir.

According to another variant, the applicator element 36 comprises a silicone sheet enclosing the cosmetic product to be applied to the hair. The silicone sheet is then designed to wear away in contact with the hair in order to release the cosmetic product. The silicone sheet can have a thickness of between 0.1 and 3 mm.

According to yet another variant, the applicator element 36 comprises a sheet enclosing the cosmetic product to be applied to the hair, in the form of microcapsules that are released when the sheet comes into contact with the hair to be treated. In this case, the sheet can be fibrous, the microcapsules being fixed to the fibres. Notably, the sheet can then be made of cotton. The fibrous sheet preferably has a thickness of between 0.1 and 3 mm.

The lower arm 16, which does not receive the refill 32, advantageously has a steam outlet 44 fed by a device 46 for forming steam, and/or a comb 48. The steam outlet 44 makes it possible to apply steam to the lock of hair treated. The steam outlet 44 can be disposed facing a portion of the applicator element 36 of the cosmetic product refill 32. The steam can thus make it easier to liquefy the cosmetic product to be applied before the latter reaches the part of the applicator element 36 disposed between the two heating elements 26, 28.

Thus, the application of the cosmetic product to the lock of hair introduced into the device 10 takes place after combing and the application of steam, concomitantly with the straightening carried out by the heating elements 26, 28. This is because the hair introduced between the jaws 12, 14 comes into contact with the applicator member 36 after having been exposed to the steam, while it is pressed between the heating elements 26, 28 while the lock is moved between the jaws 12, 14 of the device.

As illustrated in FIGS. 1 and 2, the implementation of the device for treating the hair provided with its cosmetic product refill 32 makes it possible to reduce the width of the device for treating the hair. This is because it is no longer necessary to provide a pressing element opposite the applicator element 36 that is separate from the heating elements 26, 28, since the heating elements 26, 28 enclose the hair to be treated, the applicator element 36 thus ensuring that the hair comes into contact with the cosmetic product contained in the applicator element 36. Moreover, the configuration illustrated makes it possible to treat the hair fibre right from the root in a single movement of the device for treating the hair.

It should also be noted that the configuration illustrated is particularly advantageous when the cosmetic product has to be heated in order to be applied to the hair (for example in order to make it liquid), since the heating plates 26, 28 make it possible to heat the applicator element 36 at the location at which it is in contact with the hair to be treated. It is then possible to limit the quantity of cosmetic product which is not applied to the hair.

The invention is not limited just to the examples described above, and numerous variants that are accessible to a person skilled in the art are possible without departing from the scope of the invention.

For example, the device for treating the hair described here comprises two heating elements facing one another. However, the invention can be applied in the case in which the device for treating the hair comprises a single heating element for the hair.

Furthermore, the device for treating the hair described with reference to the figures comprises a steam generator for treating the hair with steam. However, the invention can also be implemented when the device for treating the hair does not have such a device for generating steam.

The invention claimed is:

1. A cosmetic product refill for a device for treating hair, the device including at least one heating element, the cosmetic product refill comprising:

a cosmetic product applicator element in the form of a sheet; and a rib or a groove configured to fasten the refill to the device in such a way that a part of the cosmetic product refill is offset laterally with respect to the at least one heating element, wherein at least one portion of the applicator element is designed to extend next to the at least one heating elements.

2. The cosmetic product refill according to claim 1, wherein the rib or the groove is a rib with a T-shaped cross section.

3. The cosmetic product refill according to claim 1, wherein the rib or the groove is a rib fastened to the applicator element.

4. The cosmetic product refill according to claim 3, wherein the rib is fastened to a lateral side of the applicator element.

5. The cosmetic product refill according to claim 1, wherein the rib or the groove is a groove disposed at a lateral side of the applicator element.

6. The cosmetic product refill according to claim 1, wherein the applicator element is curved or able to be curved so as to extend partially next to the at least one heating element of the device for treating the hair.

7. The cosmetic product refill according to claim 1, wherein the applicator element comprises a sheet of porous material.

8. The cosmetic product refill according to claim 1, wherein the applicator element comprises a sheet of silicone.

9. The cosmetic product refill according to claim 1, wherein the applicator element is fibrous.

10. The cosmetic product refill according to claim 9, wherein the fibrous applicator element comprises encapsulated cosmetic product fixed to fibers of the fibrous applicator element.

11. The cosmetic product refill according to claim 1, wherein a portion of the applicator element that is not intended to be in contact with the hair to be treated forms a cosmetic product reservoir.

12. The cosmetic product refill according to claim 11, wherein the portion of the applicator element that forms the cosmetic product reservoir has greater porosity than a portion of the applicator element that is intended to be in contact with the hair to be treated.

13. The cosmetic product refill according to claim 1, wherein the applicator element has a thickness of between 0.1 mm and 3 mm.

14. A device for treating hair, comprising:

at least one arm provided with a heating element for the hair to be treated; and the cosmetic product refill according to claim 1 fastened to one of the at least one arm.

15. The device for treating hair according to claim 14, wherein the one of the at least one arm to which the cosmetic product refill is fastened forms a housing for receiving the cosmetic product refill.

16. The device for treating hair according to claim 14, wherein the one of the at least one arm to which the cosmetic product refill is fastened comprises a complementary groove or complementary rib for interfacing with the rib or the groove of the cosmetic product refill.

17. The device for treating hair according to claim 16, wherein the complementary groove or the complementary rib is a longitudinal groove or a longitudinal rib corresponding to the rib or the groove, respectively, of the cosmetic product refill, and the cosmetic product refill is fastened to the one of the at least one arm by sliding.

18. The device for treating hair according to claim 14, further comprising, on one of the at least one arm, a steam outlet.

19. The device for treating hair according to claim 18, wherein the steam outlet is disposed facing a portion of the applicator element of the cosmetic product refill.

20. The device for treating hair according to claim 14, wherein the at least one arm comprises at least two arms, each of the at least two arms being provided with a heating element for the hair to be treated such that the heating elements face one another in a moved-together position of the at least two arms.

* * * * *